United States Patent [19]

Berlincourt

[11] Patent Number: 4,652,231

[45] Date of Patent: Mar. 24, 1987

[54] GAS CONTROL CIRCUIT

[75] Inventor: Don A. Berlincourt, Russell Township, Cuyahoga County, Ohio

[73] Assignee: Channel Products, Inc., Chesterland, Ohio

[21] Appl. No.: 705,894

[22] Filed: Feb. 26, 1985

[51] Int. Cl.[4] ..... F23N 5/00

[52] U.S. Cl. ..... 431/78; 431/46; 431/66; 431/69; 340/579

[58] Field of Search ..... 431/75, 78, 25, 42, 431/43, 46, 50, 59, 69, 66; 328/6; 340/577, 579; 307/117

[56] References Cited

U.S. PATENT DOCUMENTS 4,088,984 5/1978 Muramoto et al. ..... 431/78 X 4,427,363 1/1984 Hammond ..... 431/78 X

*Primary Examiner*—Margaret A. Focarino

*Attorney, Agent, or Firm*—James A. Hudak

[57] ABSTRACT

An improved electrical circuit for controlling the operation of a gas solenoid valve which regulates the flow of gas to a burner. Field effect transistors, whose operation is controlled by a flame rectification circuit and/or a timing circuit, directly control the operation of a relay which, in turn, operates the gas solenoid valve, thus eliminating the need for much more complicated circuitry to effect actuation of the gas solenoid valve.

20 Claims, 6 Drawing Figures

GAS CONTROL CIRCUIT

TECHNICAL FIELD

This invention generally relates to a gas control electrical circuit for a burner, and more particularly to an improved control circuit that is much simpler, structurally and operationally, and more reliable than prior art control circuits.

BACKGROUND ART

Gas control electrical circuits which utilize an electromechanical relay to control the operation of a gas solenoid valve which, in turn, regulates the flow of gas to a burner are known in the prior art. Such circuits might utilize flame rectification techniques to provide the voltage required to actuate or to maintain actuation of the foregoing relay. Additionally, such circuits might incorporate a timing mechanism permitting the actuation of the relay for a predetermined period of time, and if ignition does not occur during this time period, causing the deactuation of the relay to prevent gas from accumulating within the system. Gas purging techniques might also be employed before and/or after the predetermined time period to prevent such gas accumulation.

These prior art circuits typically use silicon controlled rectifiers (SCR's) to control the electromechanical relay which controls the gas solenoid valve. Alternatively, the gas solenoid valve may be controlled directly by the SCR. Other circuit elements, such as bipolar or field effect transistors, are typically used to control the operation of the SCR. Thus, the resulting control circuits are relatively complex structurally and operationally, costly to produce, and present reliability problems due to their inherent complexity.

Because of the foregoing, it has become desirable to develop a simple, inexpensive, reliable electrical circuit for controlling the operation of a gas solenoid valve which regulates the flow of gas to a burner.

BRIEF SUMMARY OF THE INVENTION

The present invention solves the aforementioned problems associated with the prior art as well as other problems by providing a gas control electrical circuit wherein the relay controlling the gas solenoid valve is directly actuated by field effect transistors. In this manner, the SCR and numerous other circuit components are eliminated, thus minimizing the number of components required to control the operation of the gas solenoid valve. Due to the minimization of the number of components, the resulting circuit is simple structurally, inexpensive to produce, and reliable. In addition, the circuit can be used in conjunction with a flame rectification circuit and/or a timing circuit as described in alternate embodiments of the invention. And lastly, the circuit can be operated at line voltage or from lower voltage sources making its application extremely versatile.

DESCRIPTION OF THE PREFERRED EMBODIMENT

Figure 1:
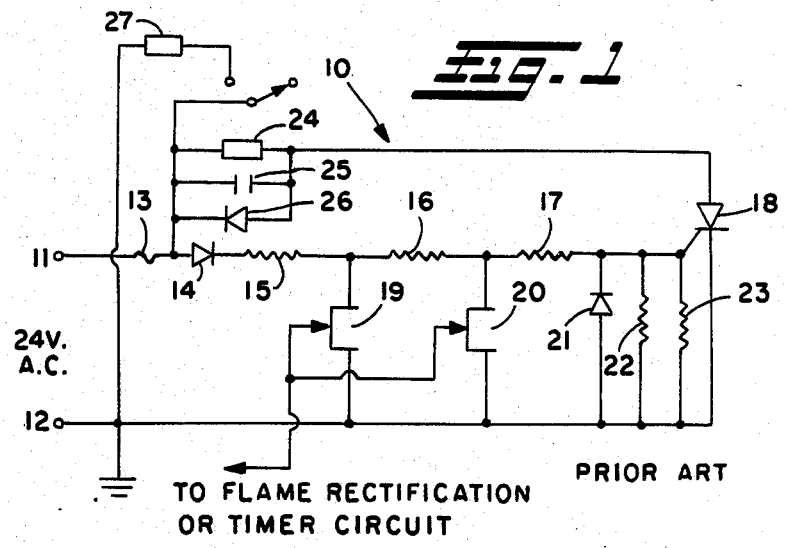
FIG. 1 is a schematic drawing of a prior art electrical circuit for controlling the operation of a gas solenoid valve which regulates the flow of gas to a burner.
Figure 2:
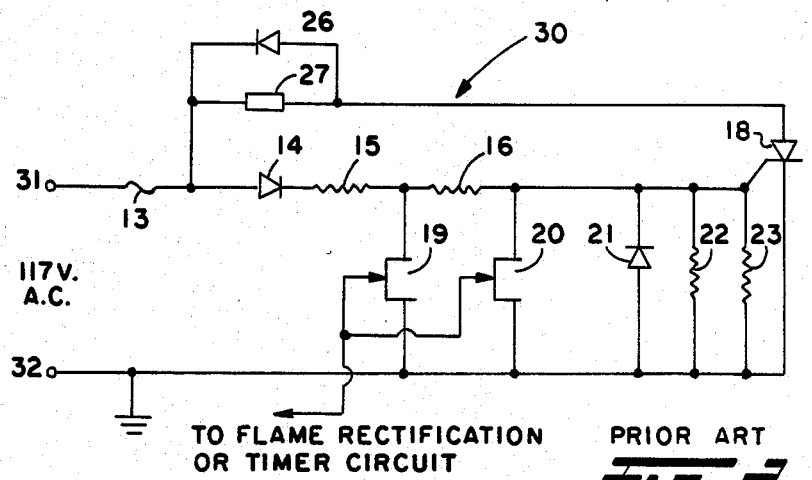
FIG. 2 is a schematic drawing of another prior art electrical circuit for controlling the operation of a gas solenoid valve which regulates the flow of gas to a burner.

Referring now to the drawings, where the illustrations are for the purpose of describing the preferred embodiment of the present invention and are not intended to limit the invention hereto, FIGS. 1 and 2 are schematic drawings of two different prior art electrical circuits utilized to control the operation of a gas solenoid valve which controls the flow of gas to a burner. The device shown in FIG. 1 utilizes 24 volts AC as its power source and controls a gas supply solenoid valve through a slave relay, whereas the device illustrated in FIG. 2 utilizes 117 volts AC as its power source and controls the gas supply solenoid valve directly.

FIG. 1 illustrates schematically a prior art electrical circuit, shown generally by the numeral 10, for controlling the operation of a gas solenoid valve 27. The circuit 10 is provided power by a 24 volt AC power supply connected to its input terminals 11 and 12. Terminal 12 is connected to ground potential. Half-wave rectified DC power is provided to the gate of an SCR 18 via a diode 14 and resistors 15, 16 and 17. A fuse 13 is connected between the terminal 11 and the anode of the diode 14 to provide overload protection to the circuit 10, as hereinafter described. A field effect transistor 19 is connected to the junction of resistors 15 and 16 and to ground potential. Similarly, a field effect transistor 20 is connected to the junction of the resistors 16 and 17 and to ground potential. Resistors 22 and 23 prevent false firing of the SCR 18. The anode of the SCR 18 is connected, via a relay coil 24, to the junction of the fuse 13 and the diode 14, and the cathode of the SCR is connected to ground potential. A filter capacitor 25 is connected in parallel with the relay coil 24 to smooth the half-wave rectified DC voltage applied to the coil 24. A diode 26 is also connected in parallel with the relay coil 24 for purposes hereinafter described. The common contact associated with the relay coil 24 is connected to the input terminal 11, via the fuse 13. This contact, which is normally open, upon actuation of the coil 24 connects one side of the gas solenoid valve 27 to the input terminal 11 and thus to the 24 volt AC power supply; the other side of the solenoid valve 27 being connected to the input terminal 12.

Operationally, the negative voltage produced by a flame rectification circuit or a timer circuit is applied to the gates of the transistors 19 and 20. If an insufficient negative voltage is applied to these gates, the transistors 19 and 20 provide a very low resistance current path to ground. This low resistance path results in the application of a voltage to the gate of the SCR 18 that is insufficient to actuate same. Because of this, the relay coil 24 and gas solenoid 27 remain unactuated. If, however, the negative voltage produced by the flame rectification circuit or the timer circuit is sufficiently negative to turn "off" the transistors 19 and 20, these transistors will present a very high resistance current path to ground which, in turn, will result in the application of a sufficient voltage to the gate of the SCR 18 to actuate same. The actuation of the SCR 18 will, in turn, cause the actuation of the relay coil 24 and the gas solenoid valve 27. In the event that the SCR 18 becomes shorted between its anode and cathode, fuse 13 opens because of the direct current path through the diode 26 and the SCR 18. Similarly, in the event of a short circuit between the anode and the gate of the SCR 18, fuse 13 opens because of the direct current path through the diode 26, the anode to gate of the SCR 18, and the diode 21. A disadvantage of this prior art circuit is that the field effect transistors 19 and 20 actuate the SCR 18 which, in turn, has failure modes that require circuit protection via the fuse 13, diode 26 and diode 21. In addition, the resistors 22 and 23 are required to prevent false triggering of the SCR 18. Thus, this prior art circuit is complex structurally and operationally, and relatively expensive to produce.

FIG. 2 illustrates schematically another prior art electrical circuit, shown generally by the numeral 30, for controlling the operation of a gas solenoid valve. Those components which are similar to the components in FIG. 1 have like reference numerals and will not be discussed further. Electrical circuit 30 differs from electrical circuit 10 in that it is powered by a 117 volt AC power supply (connected across its input terminals 31 and 32), rather than by a 24 volt AC power supply, and the gas solenoid valve 27 is operated directly by the SCR 18 rather than by a relay. It further differs in that no filter capacitor is required across the gas solenoid valve 27 because the diode 26 provides a circulating current which, due to the inductance of the solenoid valve 27, prevents the current from dropping to zero through the valve 27 and thus prevents valve "chatter". As in the electrical circuit 10, in the event that the SCR 18 becomes shorted between its anode and cathode, the diode 26 presnts a direct current path causing the fuse 13 to open. Similarly, if the SCR 18 becomes shorted between its anode and gate, the diodes 26 and 21 present a current path causing the fuse 13 to open.

Operationally, the circuit 30 is very similar to the circuit 10 in that the field effect transistors 19 and 20 provide a very low resistance path to ground if an insufficient negative voltage is applied to their gates. This low resistance path results in a gate voltage to the SCR 18 that is insufficient to actuate same, and thus the gas solenoid valve 27 is not actuated. If, however, sufficient negative voltage is applied to the gates of the transistors 19 and 20, these transistors will turn "off" and thus provide a very high resistance path to ground, which, in turn, will result in a voltage to the gate of the SCR 18 that is sufficient to actuate same. Actuation of the SCR 18 causes the actuation of the gas solenoid valve 27. A major disadvantage of this electrical circuit 30 is that it is susceptible to line transients. The prior art electrical circuit 10 illustrated in FIG. 1 is also susceptible to transient voltages, however, the transformation from 117 volts AC to 24 volts AC provides some protection from such voltages. By directly connecting the electrical circuit 30 to the 117 volt AC power supply, as shown in FIG. 2, line transients can cause a momentary shorting of the SCR 18 which can result in a high current flow through the diode 26. Such a high current flow could destry the fuse 13 and/or the SCR 18. The foregoing problem can be alleviated by a transient suppression network and/or suppression components but the cost of same is quite significant.

Figure 3:
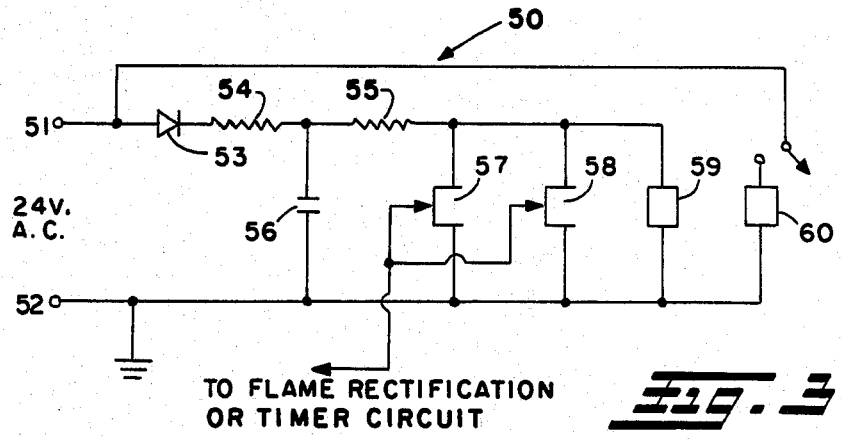
FIG. 3 is a schematic drawing of the improved electrical circuit of the present invention.

With respect to the present invention, FIG. 3 is a schematic drawing of an improved electrical circuit 50 for controlling the operation of a gas solenoid valve 60. As such, because of its overall simplicity, electrical circuit 50 differs significantly, operationally and structurally, from the electrical circuits 10 and 30 illustrated in FIGS. 1 and 2, respectively. The circuit 50 is provided power by a 24 volt AC power supply connected to its input terminals 51 and 52. Terminal 52 is connected to ground potential. Half-wave rectified DC power is provided to a relay coil 59 via a diode 53 and resistors 54 and 55. A ripple smoothing capacitor 56 is connected to the junction of the resistors 54 and 55 and to ground potential. A pair of field effect transistors 57 and 58 is connected in parallel with the relay coil 59, and controls the operation of same, as hereinafter described. A normally open contact associated with the relay coil 59 is connected to the input terminal 51 and, upon actuation of the relay coil 59, connects the gas solenoid valve 60 across the input terminals 51 and 52.

Typical resistance values for resistors 54 and 55 are 100 ohms and 2200 ohms, respectively. It should be noted that the function of resistor 54 is to limit current inrush into the capacitor 56, whereas resistor 55 acts as a "voltage divider" with the relay coil 59 when the field effect transistors 57 and 58 are turned "off". The relay 59 must be sensitive, i.e., it must be capable of operating at less than approximately 100 milliwatts of power. For example, a 12 volt, 1400 ohm relay that is rated to operate at 80 percent of its rated voltage may be used. The power required to operate such a relay is approximately 66 milliwatts. The field effect transistors 57 and 58 have an "on" resistance of typically less than 20 ohms, however, if a sufficient negative voltage is applied to their gates, the resistance of each increases to in excess of one megohm. Such a negative voltage can be provided by a flame rectification circuit or a timer circuit, both of which are hereinafter described in other embodiments of the present invention.

As for the operation of circuit 50, if the negative voltage produced by the flame rectification circuit or timer circuit is low, i.e., it is more positive than −3 or −4 volts, the field effect transistors 57 and 58 provide a very low resistance (less than 20 ohms) path to ground. If 24 volts AC power (34 volts peak to peak) is applied to the input terminals 51 and 52 under these conditions, the voltage applied to the relay coil 59 is approximately 0.15 volts, i.e., $34(20\times\frac{1}{2})/2200=0.15$ volts, which is insufficient to actuate same. Thus, the gas solenoid valve 60 remains unactuated preventing the flow of gas to the burner. If, however, the negative voltage produced by the flame rectification circuit or timer circuit is sufficiently negative, i.e., more negative than −3 or −4 volts, then the resistance of the field effect transistors increased to over 1 megohm and, in effect, each transistor acts as an open circuit. In this case, if 24 volts AC power (34 volts peak to peak) is applied to the input terminals 51 and 52, the voltage applied to the relay coil 59 is approximately 13.2 volts, i.e., $34(1400)/1400+2200)=13.2$ volts, which assures the operation of the relay coil 59 and the actuation of the gas solenoid valve 60 permitting the flow of gas to the burner. The relay coil 59 will "drop out" after actuation if the voltage applied thereto drops below 10 or 20 percent of its rated voltage. Thus, with a lower "drop out" voltage of 1.2 volts, there is significant margin of safety between this voltage and the 0.15 volts which is applied to the relay coil 59 when both field effect transistors 57 and 58 are turned "on". In addition, even if one of the transistors 57, 58 should develop an "open" condition, the foregoing margin of safety will still remain large.

A comparison of the electrical circuit 50 of the present invention with the prior art electrical circuit 10, shown in FIG. 1, reveals that circuit 50 accomplishes the same purpose, i.e., actuation of the gas solenoid valve when sufficient negative voltage has been applied to the gates of the field effect transistor with substantially fewer components. For example, circuit 50 does not require resistors 17, 22, 23; diodes 21, 26; capacitor 25; fuse 13; and SCR 18 to accomplish the foregoing. Thus, due to the reduction in components required, the circuit 50 is much less costly to produce and is more reliable during operation.

Figure 4:
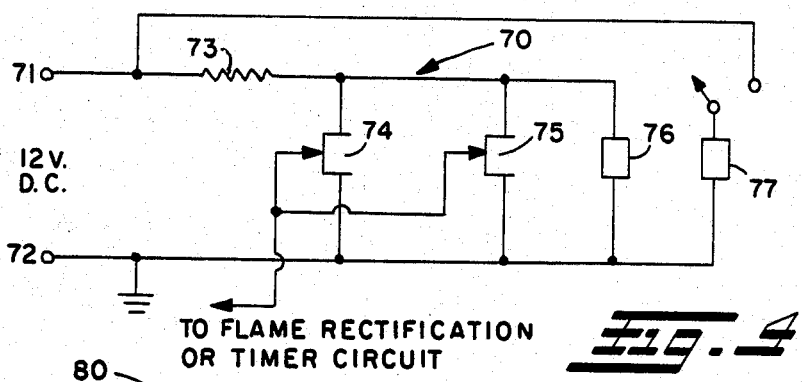
FIG. 4 is a schematic drawing of another embodiment of the improved electrical circuit of the present invention.

Another embodiment of the present invention is illustrated schematically in FIG. 4, which shows an electrical circuit 70 which controls the operation of a gas solenoid valve 77. The circuit 70 is provided power by a 12 volt DC power supply connected to its input terminals 71 and 72. Terminal 72 is connected to ground potential. DC power is supplied to a relay coil 76 via a resistor 73 having a value of approximately 400 ohms. The relay 76 typically has a sensitivity of less than approximately 100 milliwatts, is rated at 6 volts, has a resistance of approximately 350 ohms, and operates at 80 percent of its rated voltage, or 4.8 volts. From the foregoing specifications, the power required to operate this relay is approximately 66 milliwatts. A pair of field effect transistors 74 and 75 is connected in parallel with the relay coil 76 and controls the operation of same. These transistors 74 and 75 each have an "on" resistance of approximately 8 ohms, however, if a sufficient negative voltage is applied to their gates, the resistance of each increases to in excess of one megohm. A normally open contact associated with the relay coil 76 is connected to one side of the gas solenoid valve 77 and, upon actuation of the relay coil 76, connects the solenoid valve 77 across the input terminals 71 and 72.

Operationally, in the absence of a sufficient negative voltage, such as that produced by a flame rectification circuit or a timer circuit, to turn "off" the field effect transistors 74 and 75, the voltage applied to the relay coil 76 is approximately 0.12 volts, i.e., $12(8\times\frac{1}{2})400=0.12$ volts, which is insufficient to actuate same. Thus, the gas solenoid valve 77 remains unactuated preventing the flow of gas to the burner. If, however, the foregoing negative voltage comes sufficiently negative to turn "off" the transistors 74 and 75, the resistance of each transistor increases dramatically and each transistor acts as an open circuit, Under this condition, the voltage applied to the relay coil 76 is approximately 5.6 volts, i.e., $12(350)/(350+400)=5.6$ volts, which assures the operation of the relay coil 76 and the actuation of the gas solenoid valve 77 permitting the flow of gas to the burner. As in the previous embodiment, the relay coil 76 will "drop out" after actuation if the voltage applied thereto drops below 10 or 20 percent of its rated voltage. Thus, with a lower "drop out" voltage of 0.6 volts, there is a significant margin of safety between this voltage and the 0.12 volts which is applied to the relay coil 76 when both field effect transistors 74 and 75 are turned "on". This margin of safety can be increased further by adding one or more additional field effect transistors in parallel with the transistors 74 and 75 and/or by adding resistances between the field effect transistors, i.e., in the line which connects input terminal 71 with the relay coil 76.

Figure 5:
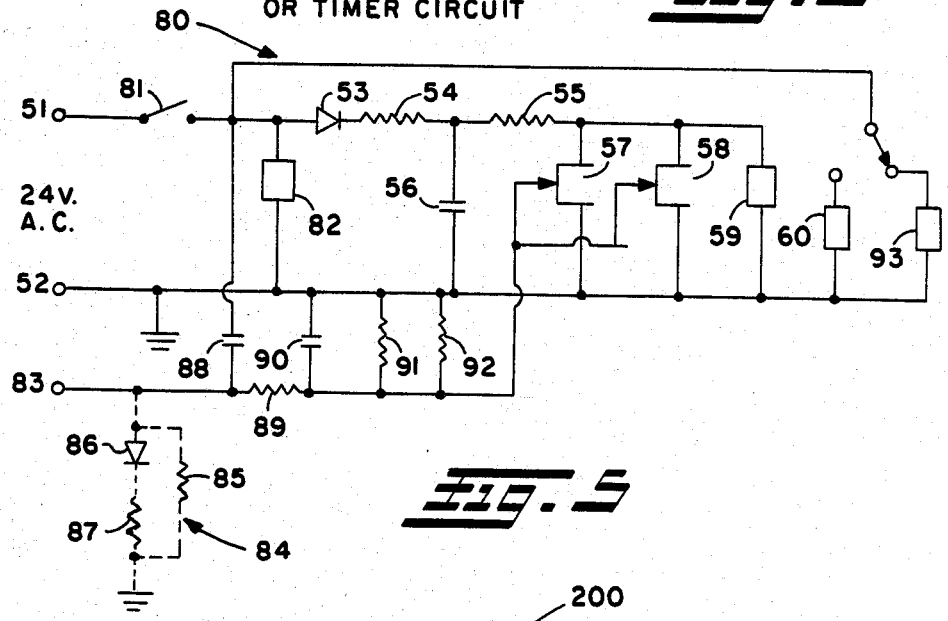
FIG. 5 is a schematic drawing of another embodiment of the improved electrical circuit of the present invention resulting from combining a flame rectification circuit with the circuit shown in FIG. 3.

Referring now to FIG. 5, a further embodiment of the present invention is illustrated schematically as electrical circuit 80 which controls the operation of a gas solenoid valve. This embodiment of the present invention utilizes the embodiment illustrated in FIG. 3 and incorporates the use of a flame rectification circuit therein. Those components which are similar to the components in FIG. 3 have like reference numerals and will not be discussed further. The circuit 80 includes a thermostat 81 whose contacts are connected between the anode of the diode 53 and the input terminal 51, and a pilot burner solenoid valve 82 which is connected to the anode of the diode 53 and to ground potential. The input terminal 83 is connected to a metallic probe or flame electrode which is immersed in the burner flame. The equivalent electrical circuit of the flame is shown generally by the numeral 84 and is comprised of a resistor 85 connected in parallel with a series combination of a diode 86 and another resistor 87. A capacitor 88 is connected to the junction of the thermostat contacts 81 and the diode 53, and to the input terminal 83. The input terminal 83 is also connected to the gate of the field effect transistors 57 and 58 via a resistor 89. In addition, a parallel combination of a capacitor 90, resistor 91 and resistor 92 is connected to the input terminal 52 and to the gates of the transistors 57 and 58. And lastly, the common contact associated with the relay coil 59 connects the 24 volt AC power supply to the gas solenoid valve 60 when the coil 59 is actuated, and connects the power supply to an electronic spark device 93 when the coil 59 is unactuated.

The electrical circuit 80 operates in the following manner: When the thermostat 81 "calls" for heat, its contacts close causing the 24 volt AC power supply to be connected across the pilot burner solenoid valve 82 actuating same allowing pilot gas to flow to the pilot burner (not shown). Simultaneously, the electronic spark device 93 is actuated and provides a high voltage spark at the pilot burner. While the foregoing is occurring, the field effect transistors 57 and 58 are turned "on", and thus the voltage applied to the relay coil 59 is insufficient to actuate same. Once the pilot gas is ignited, the flame acts as a low quality diode, shown schematically as the diode 86 and resistors 85 and 87, from input terminal 83 to ground potential. This action as a diode causes the capacitor 88 to be charged through the contacts associated with the thermostat 81 so that its bottom plate is negative with respect to its top plate. This charging action also causes the capacitor 90 to be charged through the resistor 89 so that its bottom plate is also negative with respect to its top plate which causes the field effect transistors 57 and 58 to be turned "off". The resistance of the transistors 57, 58 thus increases dramatically which, in turn, causes sufficient voltage to be applied to the relay coil 59 actuating same. Actuation of the relay coil 59 causes the gas solenoid valve 60 to be actuated and deactuates the electronic spark device 93. The main gas burner, which is controlled by the gas solenoid valve 60, is then ignited by the pilot flame and the field effect transistors 57, 58 remain turned "off" as long as the metallic probe or flame electrode remains immersed in the flame.

If the flame becomes extinguished while the thermostat 81 is still "calling" for heat, the capacitor 88 discharges through the resistors 89, 91 and 92, and the capacitor 90 discharges through the resistors 91 and 92. This discharging action causes the voltage applied to the gates of the field effect transistors 57 and 58 to becomes less negative resulting in these transistors 57, 58 turning "on". The actuation of these transistors 57, 58 causes the relay coil 59 to become deactuated which, in turn, deactuates the gas solenoid valve 60 and actuates the electronic spark device 93. In this manner, the aforementioned ignition sequence can be recommenced.

Figure 6:
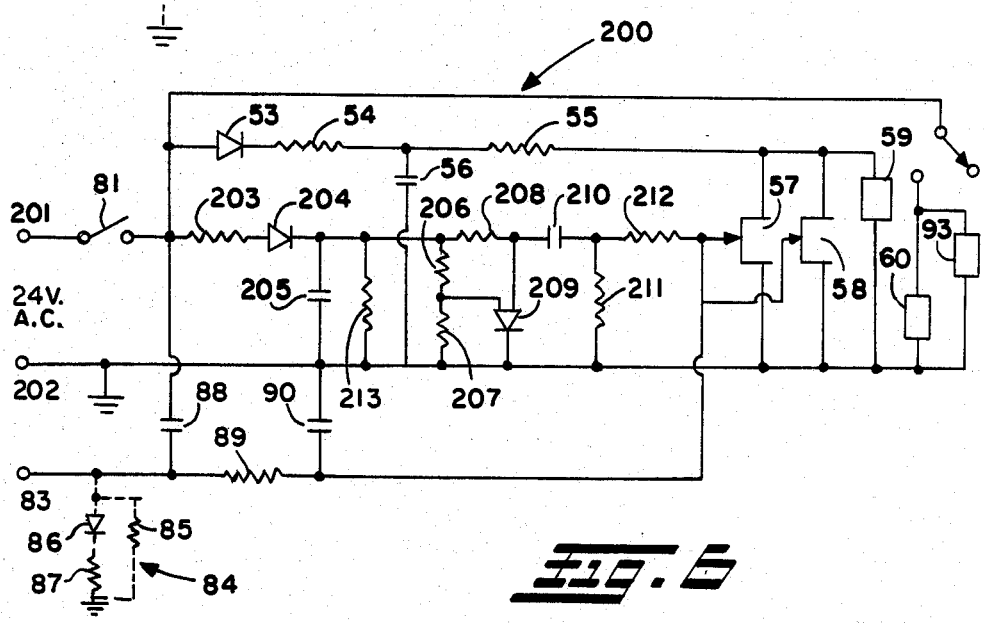
FIG. 6 is a schematic drawing of another embodiment of the improved electrical circuit of the present invention resulting from combining a timing circuit with the circuit shown in FIG. 5.

A still further embodiment of the present invention is illustrated schematically as electrical circuit 200 in FIG. 6. This embodiment is directed to a single burner device, i.e., no pilot burner, and utilizes the embodiments illustrated in FIGS. 3 and 5 and incorporates a timing circuit in conjunction with a flame rectification circuit to control the operation of a gas solenoid valve. Those components which are similar to the components in FIGS. 3 and 5 have like reference numerals and will not be discussed further. The circuit 200 is powered by a 24 volt AC power supply which is connected to its input terminals 201 and 202. Terminal 202 is connected to ground potential. Half-wave rectified DC power is supplied to a timing circuit via a resistor 203 and a diode 204 connected to the contacts associated with the thermostat 81. The timing circuit includes a capacitor 205; resistors 206, 207, 208; programmable unijunction transistor 209; capacitor 210; and resistors 211, 212 arranged and interconnected as shown. The output of the resistor 212 is connected to the gates of the field-effect transistors 57 and 58. The resistor 203 and a resistor 213 act to set the voltage for the timing circuit.

The electrical circuit 200 operates in the following manner: When the thermostat 81 "calls" for heat, its contacts close causing half-wave rectified DC power to be applied to the timing circuit, via the resistor 203 and the diode 204, and to the relay coil 59 via the diode 53 and the resistors 54 and 55. As in the previous descriptions, the field effect transistors 57 and 58 prevent actuation of the relay coil 59 unless a sufficient negative voltage has been applied to their gates. The application of the half-wave rectified DC power to the timing circuit causes the capacitor 205 to charge very rapidly through the resistor 203. Such charging typically requires less than one second. The resistor 213 acts to limit the voltage on the capacitor 205 to a safe level. The resistors 206 and 207 act as a voltage divider to bias the gate of the programmable unijunction transistor 209. Typical resistance values for the resistor 206 and 207 are 1 megohm and 10 megohms, respectively which "sets" the gate of the transistor 209 at approximately 22 volts. Thus, the transistor 209 remains unactuated until the capacitor 210 is nearly fully charged through the resistors 208 and 211. The values for the capacitor 210 and the resistors 208 and 211 may be chosen so that the charging time for the capacitor 210 is relatively long, e.g., 35 to 40 seconds for the anode voltage of the transistor 209 to exceed its gate voltage. When the voltage at the anode of the transistor 209 exceeds its gate voltage, the transistor 209 turn "on", effectively grounding the positive plate of the capacitor 210, i.e., the plate connected to the anode of the transistor 209. This grounding action causes the capacitor 210 to apply a sufficiently negative voltage to the gates of the field effect transistors 57 and 58, through the resistor 212, to turn these transistors "off". The extinguishing of these transistors 57, 58 causes the relay coil 59 to become actuated which, in turn, causes the gas solenoid valve 60 and the electronic spark device 93 to become actuated. In this manner gas is permitted to flow to the burner and it is ignited by the electronic spark device 93. As soon as the transistor 209 turns "on", the capacitor 210 begins to discharge through the transistor 209 and the resistor 211. The discharge time may take approximately 5 seconds to reduce the voltage at the gates of the field effect transistors 57, 58 to a level at which the transistors 57, 58 may again turn "on". During this time the gas continues to flow to the burner and sparking continues. If the gas is not ignited during this 5 second ignition period, then the field effect transistors 57 and 58 again turn "on" which causes the deactuation of the relay coil 59, gas solenoid valve 60 and electronic spark device 93. It should be noted that the electronic spark device 93 stops sparking when its spark electrode (not shown) is immersed in a flame even though the spark device 93 is still actuated.

If the gas is ignited during the foregoing 5 second ignition period, flame rectification causes the bottom plate of the capacitor 90 to be charged negatively with resepct to its top plate, as previously described with respect to the embodiment illustrated in FIG. 5. This charging action insures that the field effect transistors 57, 58 remain turned "off" even though the capacitor 210 becomes discharged. Thus, the gas solenoid valve 60 remains actuated permitting gas flow to the burner but the electronic spark device 93 does not spark because of the existence of a flame on its spark electrode. The electrical circuit 200 remains in this state as long as the thermostat 81 is "calling" for heat. If the contacts associated with the thermostat 81 open, upon their reclosure the foregoing ignition sequence is recommenced.

If there is an interruption in the gas flow to the burner or if the flame is extinguished due to a gust of wind, the electronic spark device 93 immediately commences sparking and the relay coil 59 remains actuated. When the flame is extinguished, however, the capacitor 90 begins to discharge through the resistors 212 and 211. This discharge time may be set at approximately 5 seconds for the capacitor 90 to be discharged to the point where the field effect transistors 57, 58 are turned "on". During this 5 second period, the relay coil 59 remains actuated. If ignition is accomplished during this 5 second period, the capacitor 90 is recharged and the relay coil remains actuated. If ignition is not achieved during this period, the field effect transistors 57, 58 turn "on" causing the relay coil 59 to become deactuated which, in turn, deactuates the electronic spark device 93 and the gas solenoid valve 60 stopping the flow of gas to the burner. In any event, it should be noted that adjustments of circuit parameters readily allow a wide range of timings to be achieved.

Certain modifications and improvements will occur to those skilled in the art upon reading the foregoing. It should be understood that all such modifications and improvements have been deleted herein for the sake of conciseness and readability, but are properly within the scope of the following claims.

I claim:

1. A device for controlling the operation of a valve which regulates the flow of fuel to a fuel burner comprising:

relay means selectively responsive to the application of power thereto; and means for controlling said application of power to said relay means, said controlling means comprising switching means connected electrically in parallel with said relay means and having a first operational state preventing the application of sufficient power to said relay means to actuate said relay means and the valve and having a second operational state allowing the application of sufficient power to said relay means to cause the actuation of said relay means and the valve permitting the flow of fuel to the burner.

2. The device as defined in claim 1 wherein said controlling means further includes means for detecting the presence of a flame at the burner, said switching means being responsive to the detection of a flame at the burner by said detecting means.

3. The device as defined in claim 1 wherein said controlling means further includes timing means, said switching means being responsive to the operation of said timing means.

4. The device as defined in claim 1 wherein said switching means comprises at least one field effect transistor.

5. The device as defined in claim 1 further including means for igniting the fuel emanating from the burner.

6. The device as defined in claim 5 wherein said igniting means comprises a spark generating device.

7. The device as defined in claim 6 further including pilot gas burner means, said spark generating device cooperating with said pilot gas burner means causing ignition of the fuel emanating from said pilot gas burner.

8. The device as defined in claim 7 wherein said relay means remains unresponsive when said spark generating device is actuated.

9. The device as defined in claim 5 wherein said application of power to said relay means occurs after a predetermined first period of time.

10. The device as defined in claim 9 wherein said application of power to said relay means causes the actuation of said ignition means and the valve.

11. The device as defined in claim 10 wherein said igniting means and the valve remain actuated for a predetermined second period of time after said predetermined first period of time has elapsed.

12. The device as defined in claim 11 wherein the valve remains actuated after said predetermined second period of time has elapsed if ignition of the burner has occurred.

13. The device as defined in claim 4 wherein said at least one field effect transistor is highly conducting when in said first operational state and is essentially non-conducting when in said second operational state.

14. The device as defined in claim 4 wherein the resistance of said at least one field effect transistor is substantially less than the resistance of said relay means when said at least one field effect transistor is in said first operational state.

15. The device as defined in claim 4 wherein the resistance of said at least one field effect transistor is substantially greater than the resistance of said relay means when said at least one field effect transistor is in said second operational state.

16. A device for controlling the operation of a fuel burner comprising:

relay means selectively responsive to the application of power thereto;

means for controlling said application by power to said relay means, said controlling means comprising switching means connected electrically in parallel with said relay means and having a first operational state preventing the application of sufficient power to said relay means to actuate said relay means and having a second operational state allowing the application of sufficient power to said relay means to cause the actuation of said relay means; and valve means responsive to the actuation of said relay means, said valve means regulating the flow of fuel to the burner.

17. A device for controlling the operation of a fuel burner comprising:

a power source;

relay means responsive to the application of said power source thereto;

means for controlling said application of said power source to said relay means, said controlling means comprising switching means connected electrically in parallel with said relay means and having a first operational state preventing the application of sufficient power to said relay means to cause the actuation of said relay means; and valve means responsive to the actuation of said relay means, said valve means regulating the flow of fuel to the burner.

18. A device for controlling the operation of a valve which regulates the flow of fuel to a burner comprising:

relay means selectively responsive to the application of power thereto; and means for controlling said application of power to said relay means, said controlling means including at least one field effect transistor connected electrically in parallel with said relay means, the deactuation of said at least one field effect transistor causing the actuation of said relay means and the valve permitting the flow of fuel to the burner.

19. The device as defined in claim 18 further including means for detecting the presence of a flame at the burner, said detecting means controlling the deactuation of said at least one field effect transistor in response to the detection of flame at the burner.

20. The device as defined in claim 18 further including timing means for regulating the deactuation of said at least one field effect transistor.

* * * * *